US010071556B2

(12) United States Patent
Osakabe et al.

(10) Patent No.: US 10,071,556 B2
(45) Date of Patent: Sep. 11, 2018

(54) INKJET PRINTING APPARATUS

(71) Applicant: BROTHER KOGYO KABUSHIKI KAISHA, Nagoya-shi, Aichi-ken (JP)

(72) Inventors: Yoshinori Osakabe, Seto (JP); Tomohiro Wada, Aichi (JP); Tomohisa Higuchi, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/473,133

(22) Filed: Mar. 29, 2017

(65) Prior Publication Data

US 2017/0282568 A1 Oct. 5, 2017

(30) Foreign Application Priority Data

Mar. 31, 2016 (JP) ..... 2016-073020

(51) Int. Cl.

| | |
|---|---|
| ***B41J 23/00*** | (2006.01) |
| ***B41J 2/17*** | (2006.01) |
| ***B41J 2/175*** | (2006.01) |
| ***B41J 25/00*** | (2006.01) |
| ***B41J 2/165*** | (2006.01) |

(52) U.S. Cl.

CPC ..... *B41J 2/1721* (2013.01); *B41J 2/16535* (2013.01); *B41J 2/175* (2013.01); *B41J 25/001* (2013.01)

(58) Field of Classification Search

None

See application file for complete search history.

(56) References Cited

U.S. PATENT DOCUMENTS

2011/0199407 A1* 8/2011 Kaiho ..... B41J 2/16585 347/9
2012/0069071 A1* 3/2012 Sasaki ..... B41J 2/0452 347/11
2012/0234436 A1 9/2012 Harada et al.
2012/0236074 A1 9/2012 Harada et al.
2014/0176643 A1* 6/2014 Komaki ..... B41J 2/1721 347/36
2015/0375509 A1* 12/2015 Harada ..... B41J 2/16517 347/36

FOREIGN PATENT DOCUMENTS

JP 2012-196798 A 10/2012
JP 2012-196802 A 10/2012
JP 2015-112844 A 6/2015

* cited by examiner

*Primary Examiner* — Matthew Luu
*Assistant Examiner* — Tracey McMillion
(74) *Attorney, Agent, or Firm* — Merchant & Gould P.C.

(57) ABSTRACT

An inkjet printing apparatus, comprising: a carriage to move in a 1st direction; a recording head; an ink reservoir; an ink receiver; and a waste liquid reservoir configured to be connected to the ink receiver to let the ink move between the ink receiver and the waste liquid reservoir, wherein: the ink reservoir is disposed not to overlap with the carriage in a 2nd direction perpendicularly intersecting with the 1st direction and an up and down direction, and at least a part of the ink reservoir is disposed at a position outside of a moving range of the carriage in the 1st direction; and in the 1st direction, the waste liquid reservoir is disposed to overlap with the ink reservoir and is disposed at a position outside of the moving range of the carriage.

10 Claims, 15 Drawing Sheets

INKJET PRINTING APPARATUS

CROSS-REFERENCE TO RELATED APPLICATION

This application claims priority under 35 U.S.C. § 119 from Japanese Patent Application No. 2016-073020, filed on Mar. 31, 2016. The entire subject matter of the application is incorporated herein by reference.

BACKGROUND

Technical Field

Aspects of the present disclosure relate to an inkjet printing apparatus having a waste liquid reservoir for storing ink sucked from a recording head.

Related Art

An inkjet printing apparatus which forms an image on a sheet by ejecting ink from nozzles of a recording head is known. Such an inkjet printing apparatus includes a maintenance unit in which, in order to remove foreign substances from the nozzles of the recording head, the foreign substances in the nozzles of the recording head are sucked by a pump and are stored in a waste liquid tank. In the inkjet printing apparatus, an ink cartridge unit in which an ink cartridge is attached is disposed on one outside with respect to a paper supply cassette in a moving direction (hereafter, referred to as a left and right direction) of a carriage and the waste liquid tank is disposed on the other outside with respect to the paper supply cassette in the left and right direction.

SUMMARY

It is assumed that a user who uses a large capacity ink cartridge or a large capacity ink tank uses frequently an inkjet printing apparatus. When the inkjet printing apparatus is used frequently, the number of maintenance operation increases and thereby the amount of ink stored in the waste liquid tank increases. Therefore, regarding an inkjet printing apparatus having a large capacity ink reservoir (an ink cartridge), it becomes necessary to increase the size of a waste liquid reservoir in accordance with the size of the ink reservoir. However, various types of components are disposed in the inkjet printing apparatus. Therefore, in order to suppress increase in size of the inkjet printing apparatus, the ink reservoir needs to be disposed effectively not to interfere with the other components while achieving space saving.

When, in the above described conventional inkjet printing apparatus, an ink cartridge attachment unit is increased in size to an outside in the left and right direction where the other components are not disposed while avoiding interference with the other components, the waste liquid tank is inevitably increased to an outside in the left and right direction. Therefore, the inkjet printing apparatus is increased in size by the waste liquid tank in addition to increase in size of the ink cartridge attachment unit.

In consideration of the above, aspects of the present disclosure provide an inkjet printing apparatus configured to suppress increase in size in the left and right direction.

According to an aspect of the present disclosures, there is provided an inkjet printing apparatus, comprising: a carriage configured to move in a 1st direction; a recording head arranged on the carriage, the recording head having nozzles through which ink is ejected; an ink reservoir configured to be connected to the recording head to supply ink to the recording head; an ink receiver configured to receive the ink discharged from the recording head; and a waste liquid reservoir configured to be connected to the ink receiver to let the ink move between the ink receiver and the waste liquid reservoir. In this configuration, the ink reservoir is disposed not to overlap with the carriage in a 2nd direction perpendicularly intersecting with the 1st direction and an up and down direction, and at least a part of the ink reservoir is disposed at a position outside of a moving range of the carriage in the 1st direction. In the 1st direction, the waste liquid reservoir is disposed to overlap with the ink reservoir and is disposed at a position outside of the moving range of the carriage.

According to another aspect of the present disclosures, there is provided an inkjet printing apparatus, comprising: a carriage; a head mounted to the carriage; a 1st ink reservoir; a 2nd ink reservoir; and a ink path comprising an inlet and an outlet, the inlet being connected to the 1st ink reservoir, the outlet being connectable to the 2nd ink reservoir. At least a part of the 1st ink reservoir is disposed at a position outside of a moving range of the head in a 1st direction and not to overlap with the head in a 2nd direction perpendicularly intersecting with the 1st direction and an up and down direction. In the 1st direction, the 2nd ink reservoir is disposed to overlap with the 1st ink reservoir and is disposed not to overlap with the moving range of the head.

BRIEF DESCRIPTION OF THE ACCOMPANYING DRAWINGS

FIG. 1 is a perspective view illustrating an outer appearance of a multifunction apparatus according to an illustrative embodiment.

FIG. 2 schematically illustrates an inner configuration of a printer unit in the multifunction apparatus.

FIG. 3 schematically illustrates a maintenance unit in the multifunction apparatus.

DETAILED DESCRIPTION

Figure 1:
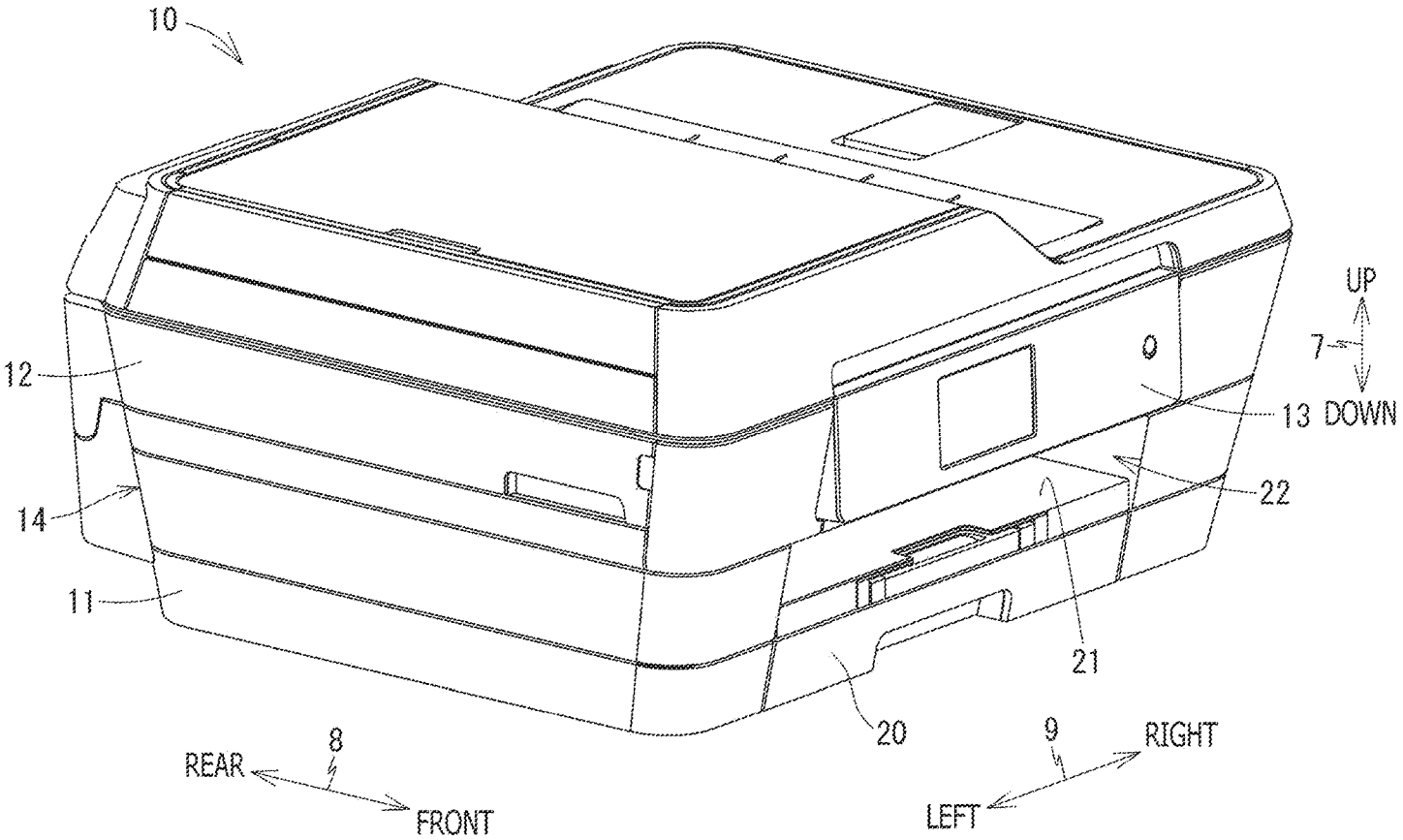

Hereinafter, an illustrative embodiment is described with reference to the accompanying drawings. In the following explanation, an up and down direction 7 is defined with respect to a state where a multifunction apparatus 10 is installed to be usable (i.e., a state shown in FIG. 1), a front and rear direction 8 is defined with respect to a state where a surface on which an opening 22 is formed is defined as a front surface, and a left and right direction 9 is defined in a state where the multifunction apparatus 10 is viewed from the front side.

(Overall Configuration of Multifunction Apparatus 10)

The multifunction apparatus 10 has the printing function and the scanner function. As shown in FIG. 1, the multifunction apparatus 10 has a rectangular parallelepiped shape constituted by a printer housing 11 and a scanner housing 12 stacked on the upper side of the printer housing 11. On the front surface of the multifunction apparatus 10, am operation panel 13 including various operation buttons and a liquid crystal display is provided.

Figure 2:
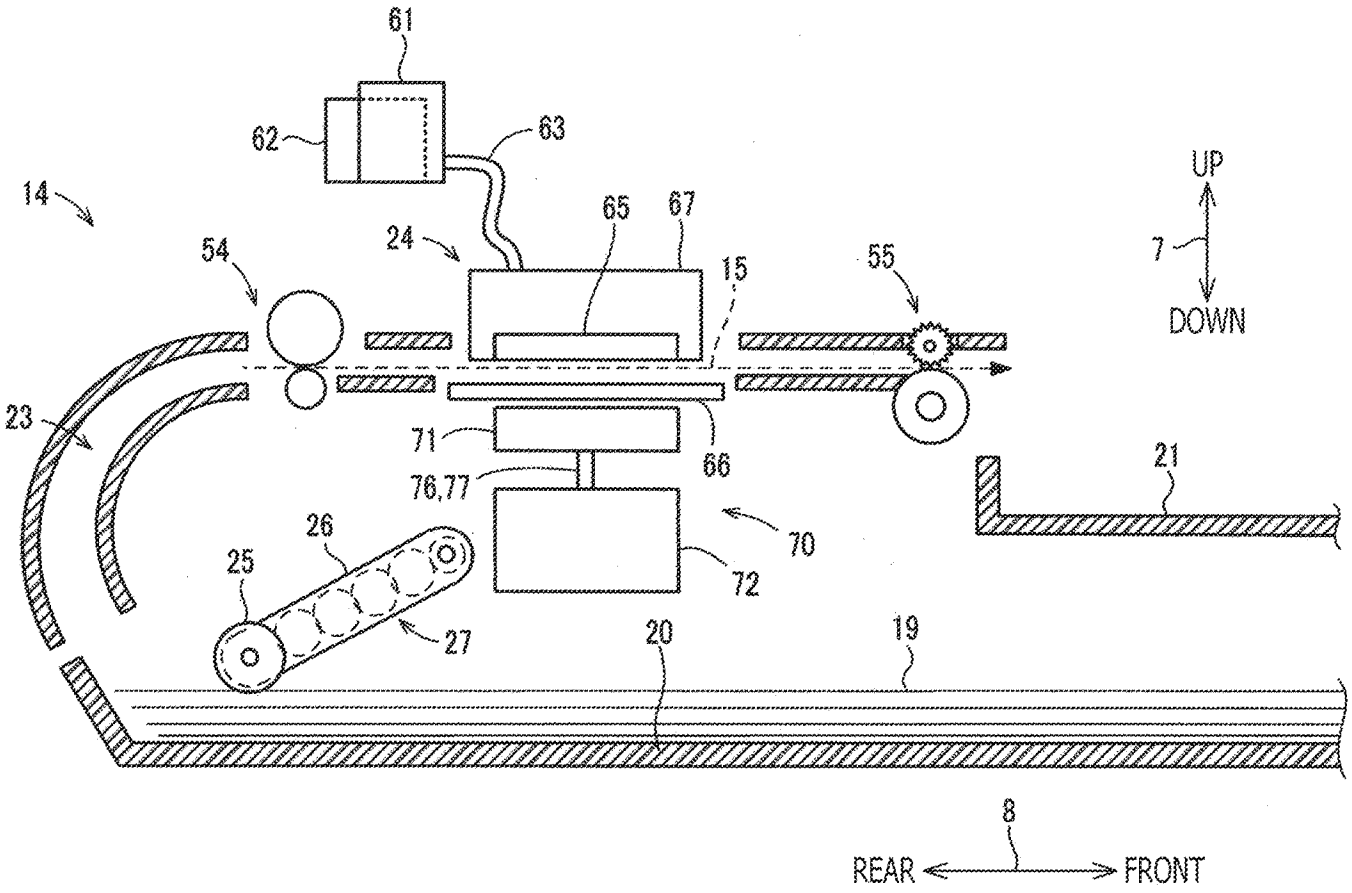

The printer housing 11 forms an outer wall of a printer unit 14 for recording an image on a recording medium 19. As shown in FIG. 2, the printer unit 14 records an image on the recording medium 19 conveyed from a supply tray 20, and discharges the recording medium 19 on which an image has been recorded to a discharge tray 21. Each of the supply tray 20 and the discharge tray 21 is detachably attachable to the printer housing 11 via the opening 22 formed on the front surface of the printer housing 11. The scanner housing 12 forms an outer wall of an image scanner unit having a flat bed scanner. Details about the image scanner unit will be described later.

(Printer Unit 14)

As shown in FIG. 2, a supply roller 25 is disposed on an upper side of the supply tray 20. A supply arm 26 rotatably supports the supply roller 25. Depending on the thickness of a plurality of recording media 19 supported on the support tray 20, the supply roller 25 moves in the up and down direction 7 and the supply arm 26 rotates depending on movement of the supply roller 25. To the supply roller 25, rotation of a motor (not shown) is transmitted via a series of gears. By letting the supply roller 25 rotate while contacting the recording medium 19 on the supply tray 20, a recording medium at the top of the stacked recording media 19 is supplied to a conveying path 23.

The conveying path 23 is formed to turn from a rear edge of the supply tray 20 toward the front side of the printer unit 14, and to extend straight toward the discharge tray 21 in the front and rear direction 8. The conveying path 23 is disposed at a central portion in the left and right direction 9 in the inside of the printer housing 11 (see FIG. 1). On the conveying path 23, a pair of conveying rollers 54 and a pair of discharge rollers 55 are provided. On the conveying path 23, the conveying rollers 54 and the discharge rollers 55 pinch the recording medium 19 to convey the recording medium 19 in a conveying direction 15. By being conveyed by at least one of the pair of conveying rollers 54 and the pair of discharge rollers 55, the recording medium 19 supplied from the supply tray 20 is U-turned from the lower side to the upper side along the conveying path 23 to reach a position under the recording unit 24, and is subjected to image forming by the recording unit 24. Then, the recording medium 19 is discharged to the discharge tray 21.

The recording unit 24 performs the image forming in an inkjet recording manner. The recording unit 24 includes a recording head 65 and a carriage 67. The carriage 67 is disposed on the upper side of the conveying path 23. By letting a driving force from a motor (not shown) be transmitted to the carriage 67 via a belt drive mechanism (not shown), the carriage 67 moves along guide rails 43 and 44 (see FIGS. 4 to 6) extending in the left and right direction 9. The recording head 65 is mounted on the carriage 67. On the lower side of the recording head 65, a platen 66 is disposed. The platen 66 is provided to expand in a region (i.e., the entire region of the conveying path 23 in the left and right direction 9) in which the carriage 67 moves, and supports, from the lower side, the recording medium 19 being conveyed along the conveying path 23. The recording head 23 faces the platen 66. By letting the recording head 65 selectively eject ink to the recording medium 19 supported on the platen 66 while the carriage 67 moves in the left and right direction 9, an image is recorded on the recording medium 19.

Figure 3:
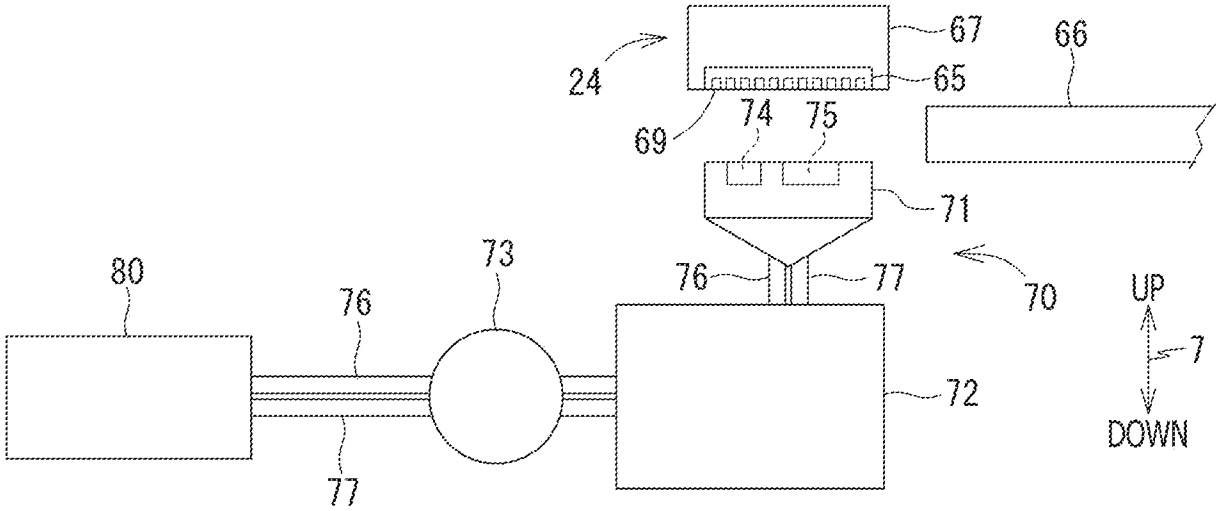

As shown in FIG. 3, on the lower surface of the recording head 65, a plurality of nozzles 69 are formed. The nozzles 69 are arranged in a plurality of rows along the conveying direction 15 (see FIG. 2). For example, four rows nozzles 69 for cyan, magenta, yellow and black ink may be formed.

Figure 4:
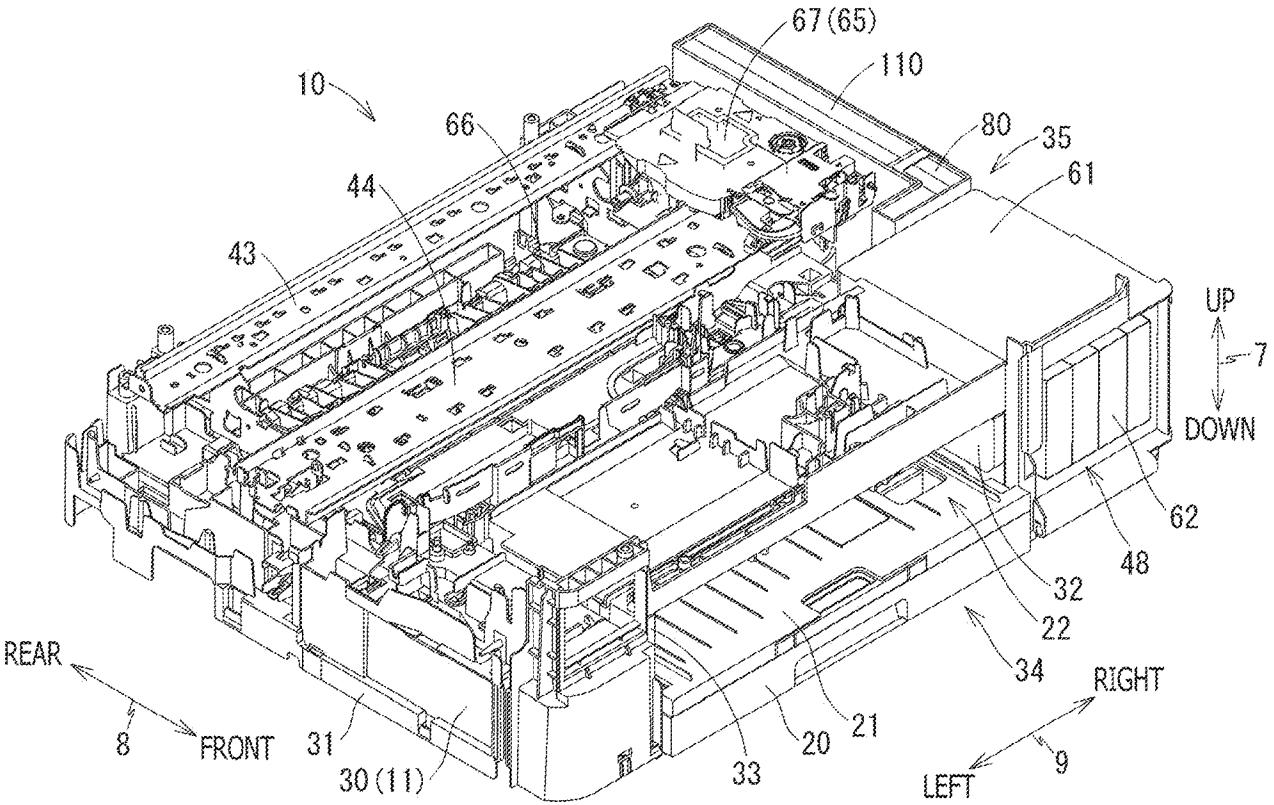
FIG. 4 is a perspective view illustrating the inner configuration of the printer unit in which a carriage is disposed at a maintenance position and a movable waste ink tank is disposed at a mounting position.
Figure 5:
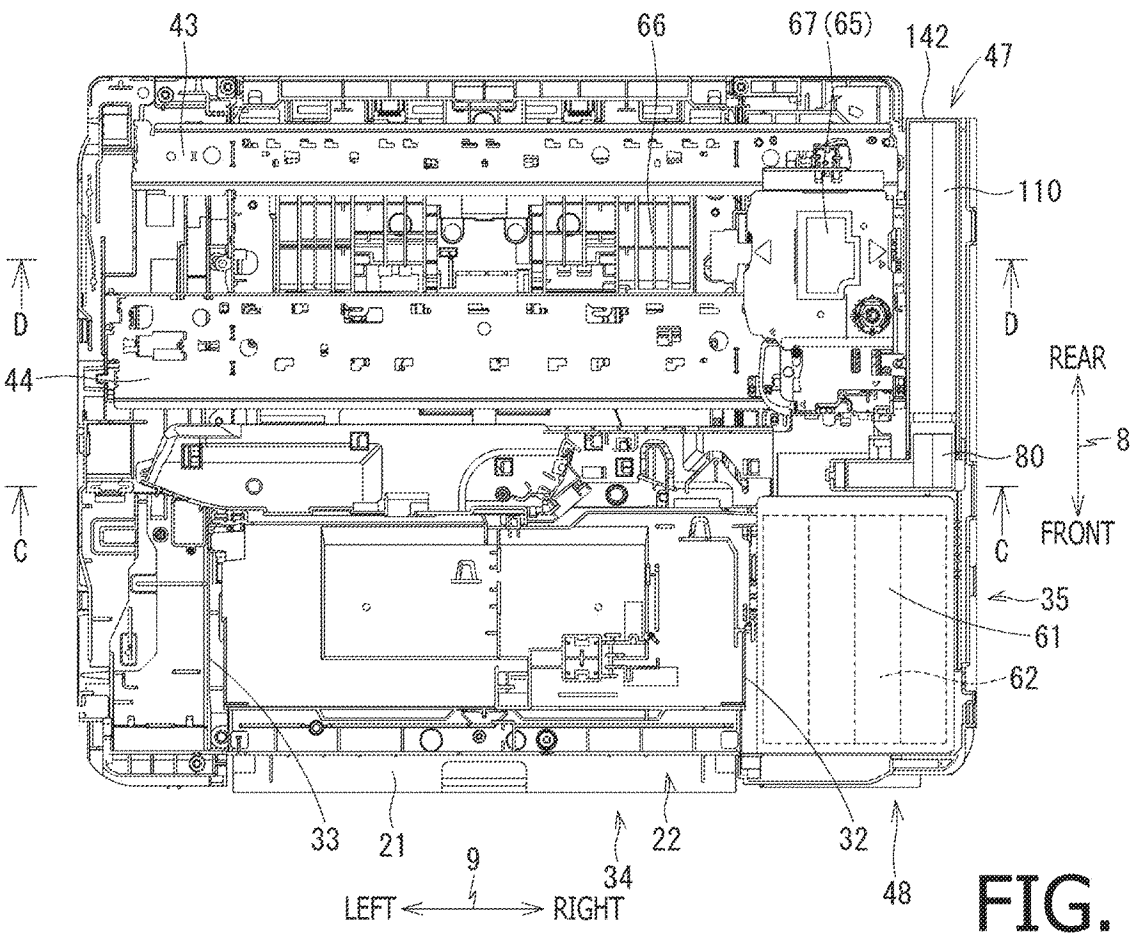
FIG. 5 is a plan view illustrating the inner configuration of the printer unit in which the carriage is disposed at the maintenance position and the movable waste ink tank is disposed at the mounting position.
Figure 6:
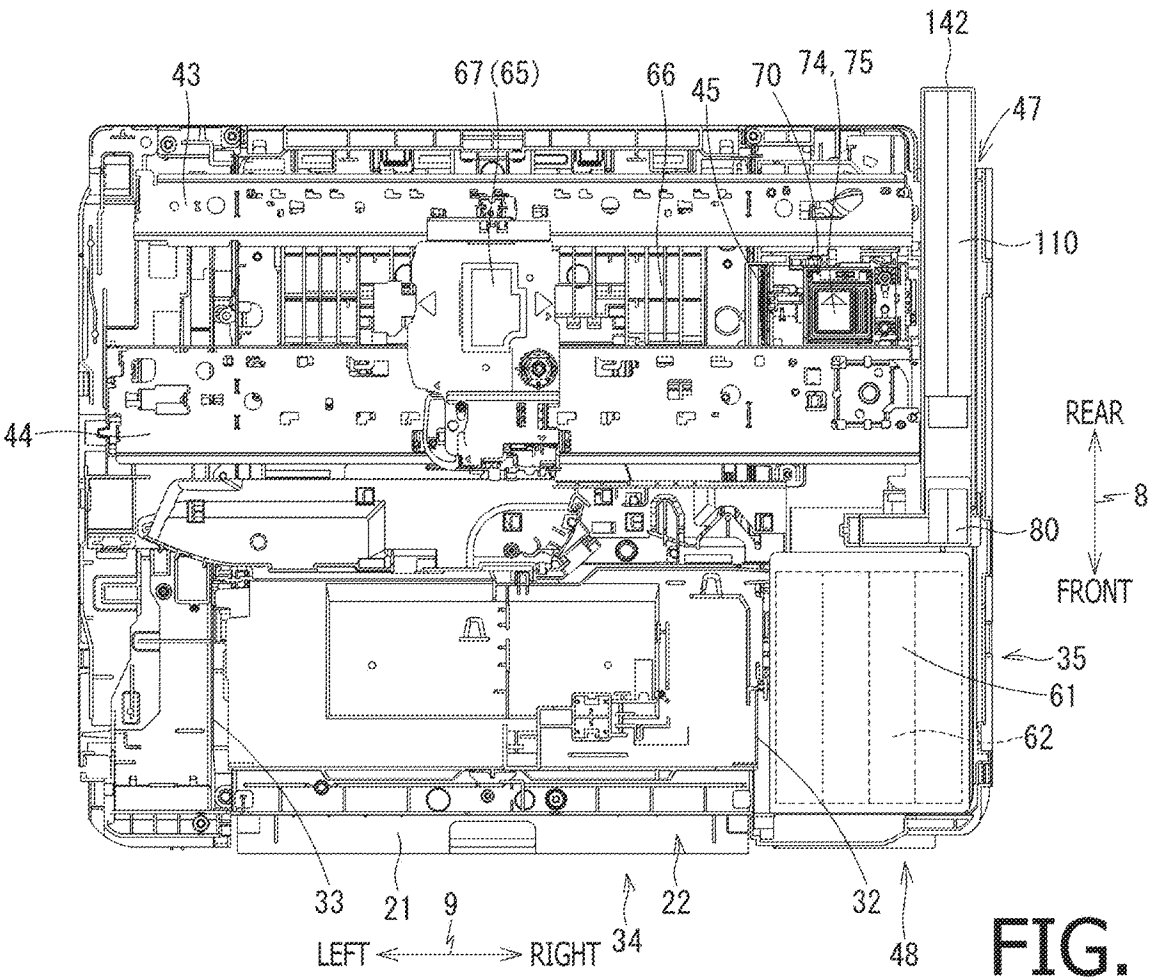
FIG. 6 is a plan view illustrating the inner configuration of the printer unit in which the carriage is disposed at a central position in a left and right direction and the movable waste ink tank is disposed at a non-mounting position.

As shown in FIGS. 4 to 6, the printer housing 11 has a lower cover 30 principally forming a lower surface and a part of the front surface of the multifunction apparatus 10. By attaching an upper cover 29 (see FIG. 13) principally forming lateral surfaces and a rear surface of the multifunction apparatus 10 to the upper side of the lower cover 30, the printer housing 11 is formed.

The lower cover 30 includes a lower wall 31 forming the lower surface of the printer housing 11, a right wall 32 and a left wall 33 defining a space 34 in which the supply tray 20 is housed. The right wall 32 and the left wall 33 are formed to project upward from the lower wall 31, and extend in parallel with each other in the front and rear direction 8. By the right wall 32 and the left wall 33, the space 34 is defined in the central portion of the lower wall 31 in the left and right direction 9. In the lower cover 30, a space 35 is formed on the upper side of the lower wall 31 and on the right side of the right wall 32. In the space 35, a maintenance mechanism 70 (see FIG. 6), an ink refilling case 61, a fixed waste ink tank 80 and a movable waste ink tank 110 are accommodated.

(Ink Refilling Case 61)

As shown in FIGS. 4 to 6, the printer unit 14 includes the ink refilling case 61. The ink refilling case 61 is disposed in a front portion in the space 35. The ink refilling case 61 is formed in a box shape having an opening on the front side. To the ink refilling case 61, a plurality of ink cartridges 62 (see FIG. 2) for storing ink of respective colors to be supplied to the recording head 65 are attached. A plurality of tubes 63 corresponding to the respective colors are formed to extend from the ink refilling case 61 to which the respective ink cartridges 62 are attached, to the recording head 65. Thus, ink is supplied from the ink filling cartridge 62 to the recording head 65 via the tubes. On the front side of the multifunction apparatus 10, the ink cartridges 62 are inserted to or removed from the ink refilling case 61 via an opening 48 of the lower cover 30.

The ink refilling case 61 and the ink cartridges 62 are disposed on the front side with respect to the carriage 67 in the space 35 of the lower cover 30. In other words, the ink refilling case 61 and the ink cartridges 62 are disposed at positions not overlapping with the carriage 67 in the front and rear direction 8 (i.e., at different positions in the front and rear direction 8). Furthermore, right edges of the ink refilling case 61 and the ink cartridges 62 are disposed on the right side with respect to the right end of the moving range of the carriage 67 in the left and right direction 9, i.e., on the right side with respect to the right edges of the guide rails 43 and 44. That is, at least a part of the ink refilling case 61 and the ink cartridges 62 is disposed on the outside with respect to the moving range of the carriage 67 in the left and right direction 9.

(Maintenance Mechanism 70)

As shown in FIG. 6, the maintenance mechanism 70 is disposed on the lower side with respect to a moving path of the recording head 65 and a right side with respect to the right edge of the platen 66 in the space 35. In a state where the carriage 67 is positioned at the right end of the moving range in the left and right direction 9, the maintenance mechanism 70 is disposed on the lower side with respect to the carriage 67. As shown in FIG. 3, the maintenance mechanism 70 sucks ink from the nozzle 69 of the recording head 65, and causes the sucked ink to flow into the fixed waste ink tank 80. In the following, the ink discharged from the nozzles 69 by the maintenance mechanism 70 is referred to as "waste ink". In FIG. 3, the fixed waste ink tank 80 is schematically illustrated to represent that the maintenance mechanism 70 and the fixed waste ink tank 80 are connected via tubes 76 and 77; however, this illustration does not intend to represent the positional relationship between the fixed waste ink tank 80 and other components.

As shown in FIG. 3, the maintenance mechanism 70 includes a movable part 71, a cam mechanism 72 for moving the movable part 71 in the up and down direction 7, the tubes 76 and 77 and a pump 73. The movable part 71 includes caps 74 and 75 made of rubber material. When the caps 74 and 75 are disposed at a maintenance position at which the carriage 67 is disposed on the upper side with respect to the movable part 71, the caps 74 and 75 faces the lower surface of the recording head 65 in the up and down direction 7. The cam mechanism 72 operates by receiving a driving force transmitted from a motor (not shown) to move the movable part 71 in the up and down direction 7. When the movable part 71 moves to the upper side, the cap 74 and 75 contact a lower surface of the recording head 65. At this time, the cap 74 covers the row of nozzle 69 ejecting black ink, and the cap 75 covers the rows of nozzles 69 ejecting cyan, magenta and yellow ink. To the caps 74 and 75, ends of the tubes 76 and 77 are connected. Each of the tubes 76 and 77 is an elastic resin tube.

The pump 73 is, for example, a rotary tube pump which operates by receiving a driving force from a motor (not shown). The pump 73 communicates with a sealed space between the lower surface of the recording head 65 and the caps 74 and 75. When the pump 73 is driven in a state where the caps 74 and 75 cover the nozzles 69, a negative pressure is caused in the caps 74 and 75 and thereby the ink discharged from the nozzles 69 is received by the caps 74 and 75. The discharged ink received by the caps 74 and 75 is caused to flow into the fixed waste ink tank 80 via the tubes 76 and 77 by operation of the pump 73. The inner space of the tube 76 is a flowing path for letting air flow, and an inner space of the tube 77 is a flowing path for letting the waste ink flow.

(Wiper 45)

As shown in FIG. 6, the maintenance mechanism 70 includes a wiper 45. The wiper 45 is disposed at the same position as that of the nozzles 69 (see FIG. 3) of the recording head 65 in the front and rear direction 8, and is disposed at a position on the left side with respect to the caps 74 and 75 within the moving range of the nozzles 69 in the left and right direction 9. The wiper 45 is formed to extend in the up and down direction 7 and to have a long shape in the front and rear direction 8. The wiper 45 is made of, for example, rubber.

The wiper 45 is movable in the up and down direction 8. When the carriage 67 is disposed at the maintenance position shown in FIGS. 4 and 5, the upper edge of the wiper 45 is disposed at a position overlapping with the nozzles 69 in the up and down direction 7. By movement of the carriage 67 to the left side, the upper edge of the wiper 45 wipes the nozzles 69. In a process where the carriage 67 moves leftward from the maintenance position, the wiper 45 wipes the nozzles 69 in a state where the upper edge part of the wiper 45 bends leftward with respect to a proximal part of the wiper 45. Therefore, after the carriage 67 has passed to the upper side of the wiper 45, the upper edge part of the wiper 45 moves rightward by restoring motion of the upper edge part. As a result, the ink adhered to the wiper 45 is scattered rightward. The ink scattered rightward is received by an ink holding body 113 via an opening 119 of the movable waste ink tank 110 which is described later.

(Fixed Waste Ink Tank 80)

As shown in FIGS. 4 to 6, the fixed waste ink tank 80 is disposed in a central portion of the space 35 of the lower cover 30 in the front and rear direction 8. The fixed waste ink tank 80 is disposed on the front side with respect to the carriage 67 and on the rear side with respect to the ink refilling case 61 and the ink cartridges 62. Furthermore, the left edge of the fixed waste ink tank 80 is disposed at a position overlapping with the moving range of the carriage 67 in the left and right direction, i.e., a position on the left side with respect to the right edge of the guide rails 43 and 44. The right edge of the fixed waste ink tank 80 is disposed on the right side with respect to the right end of the moving range of the carriage 67 in the left and right direction 9, i.e., on the right side with respect to the right edges of the guide rails 43 and 44. On the rear side of the fixed waste ink tank 80, the maintenance mechanism 70 is disposed. The tubes 76 and 77 of the maintenance mechanism 70 are extended frontward to be connected to the fixed waste ink tank 80.

Figure 12:
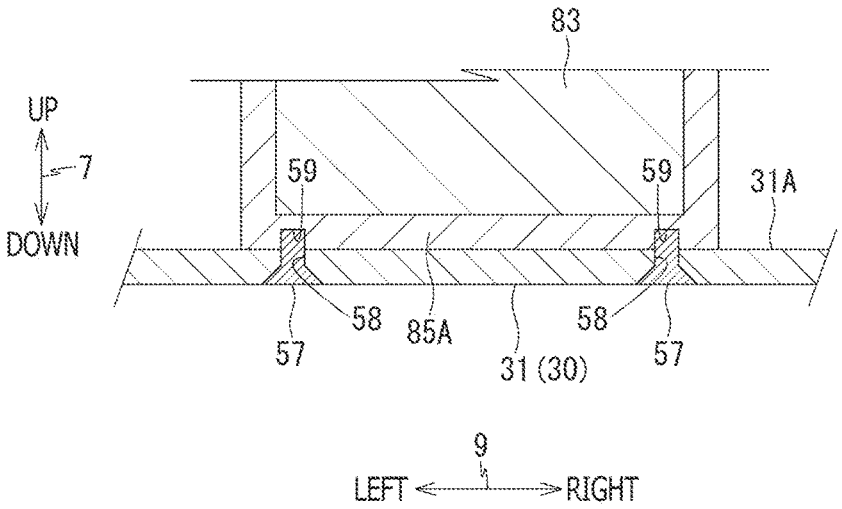
FIG. 12 is a partial cross sectional view of the fixed waste ink tank and a lower cover in a C-C cross section in FIG. 5.

The fixed waste ink tank 80 is fixed to the lower cover 30. As shown in FIG. 12, the fixed waste ink tank 80 is fixed to the lower cover 30, for example, by screws 57. Specifically, the lower cover 30 has a plurality of through holes 58 penetrating therethrough in the up and down direction 7 at positions in a region within which the fixed waste ink tank 80 is disposed. Further, the fixed waste ink tank 80 has screw holes 59 at positions respectively corresponding to the through holes of a lower wall 85A. Each of the screw holes 59 is formed with internal thread and is formed to be recessed upward from the lower surface of the lower wall 85A. The screws 57 are screwed into the screw holes 59 via the through holes 58 from the lower side of the lower wall 31 of the lower cover 30, and thereby the fixed waste ink tank 80 is fixed to the lower cover 30. The fixed waste ink tank 80 may be fixed to the lower cover 30 by another fixing manner other than screwing. For example, the lower wall 31 of the lower cover 30 and the fixed waste ink tank 80 may be provided with engagement parts, and the fixed waste ink tank 80 may be fixed to the lower cover 30 by letting the engagement parts of the lower cover 30 and the fixed waste ink tank 80 engage with respect to each other. Alternatively, the lower cover 30 and the fixed waste ink tank 80 may be integrally formed.

Figure 7:
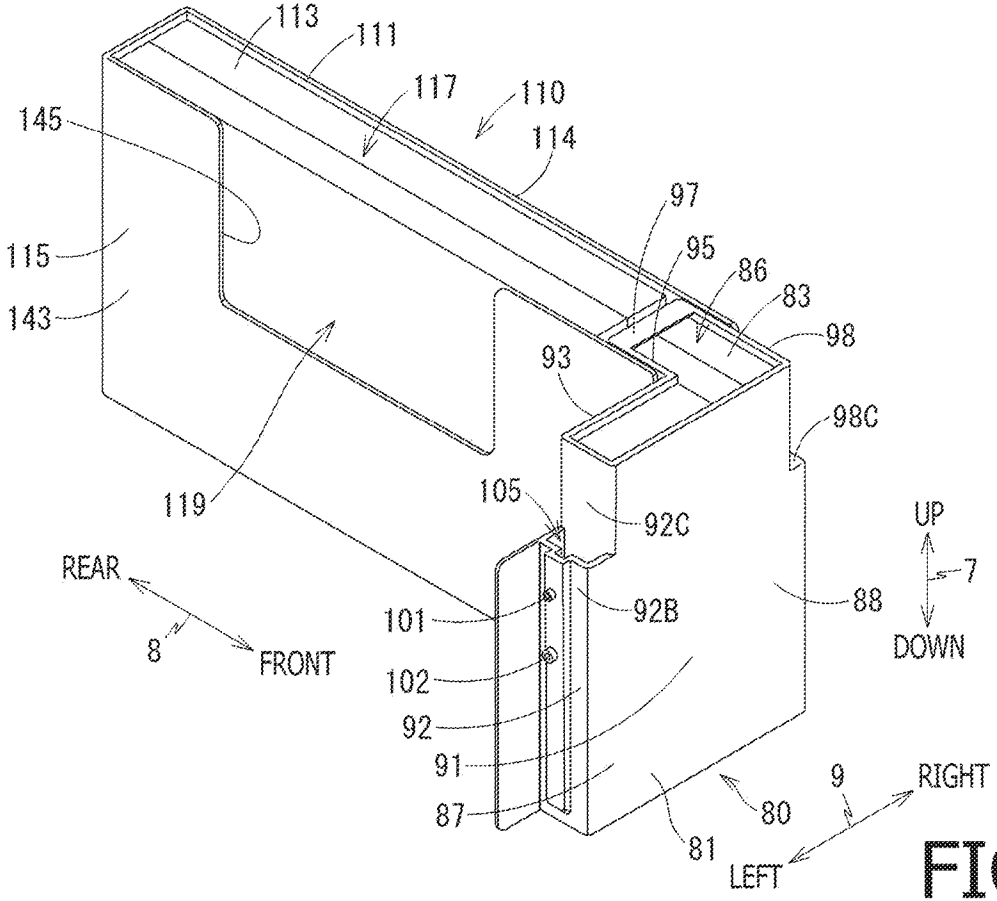
FIG. 7 is a perspective view illustrating a state where a fixed waste ink tank and the movable waste ink tank are viewed from the upper left side, where the movable waste ink tank is disposed at the mounting position.
Figure 8:
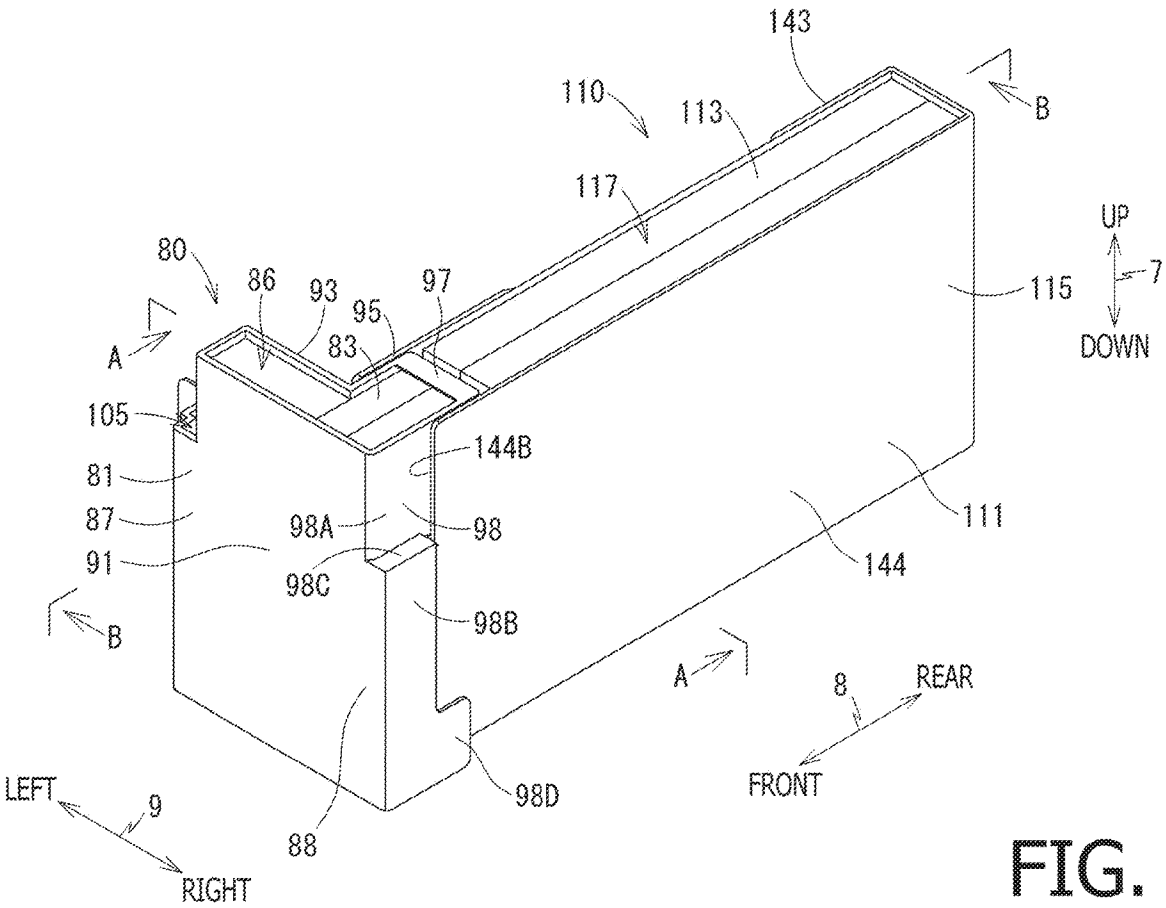
FIG. 8 is a perspective view illustrating a state where the fixed waste ink tank and the movable waste ink tank are viewed from the upper right side, where the movable waste ink tank is disposed at the mounting position.

As shown in FIGS. 7 and 8, the fixed waste ink tank 80 includes a fixed waste ink tank case 81 and an ink holding body 83.

As shown in FIGS. 7 to 10, the fixed waste ink tank case 81 is formed in a hollow box shape, and as an opening at an upper position. The opening 86 is formed in a shape of a letter of L when viewed as a plan view, and is defined by the upper edge of the fixed waste ink tank case 81.

The fixed waste ink tank case 81 includes a left part 87 formed in a rectangular parallelepiped shape expending in the left and right direction and being thinned in the front and rear direction 8, and a right part 88 formed in a rectangular parallelepiped extending successively from the right edge of the left part 87 in the front and rear direction 8 and being thinned in the left and right direction 9. The inner space of the left part 87 extends in the up and down direction 7, and communicates with the inner space of the right part 88 at the right edge of the upper portion of the left part 87. The inner space of the right part 88 extends in the front and rear direction 8, and communicates with the inner space of the left part 87 at the left edge of the front part of the right part 88. The lower edge of the inner space of the left part 87 is disposed on a lower side with respect to the lower edge of the inner space of the right part 88. The rear edge of the inner space of the right part 88 is disposed on the rear side with respect to the rear edge of the inner space of the left part 87. Specifically, the inner space of the left part 87 is partitioned by a left half part of the front wall 91, the left wall 92, the rear wall 93, a frontward middle wall 94 and the lower wall 85A.

As shown in FIGS. 7 and 8, a left half part of the front wall 91 of the fixed waste ink tank case 81 forms the front edge of the left part 87. The left half part of the front wall 91 has a rectangular plate-like shape expanding in the up and down direction 7 and the left and right direction 9.

Figure 9:
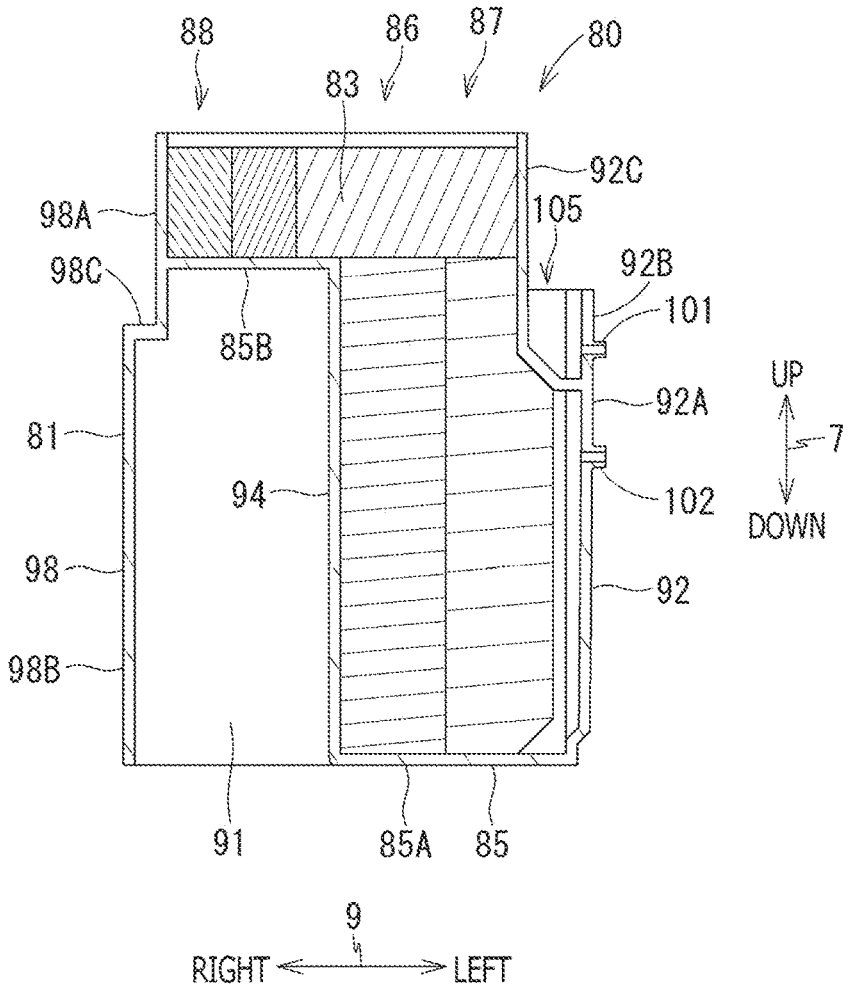
FIG. 9 is a cross sectional view of a A-A cross section in FIG. 8.

As shown in FIGS. 7 and 9, the left wall 92 of the fixed waste ink tank case 81 forms the left edge of the left part 97. The left wall 92 has a rectangular plate-like shape expanding in the up and down direction 8 and the left and right direction 9.

Figure 10:
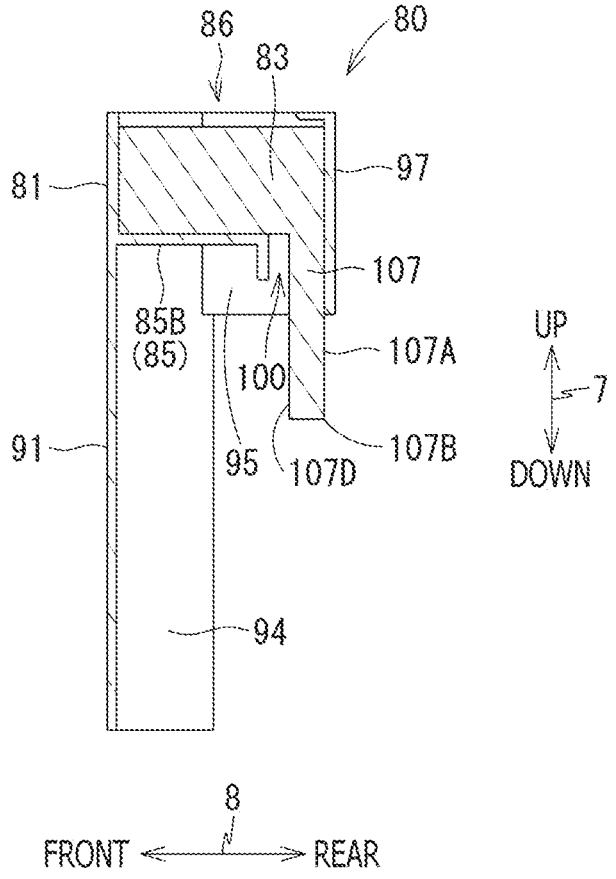
FIG. 10 is a cross sectional view of the fixed waste ink tank in a B-B cross section in FIG. 8.

As shown in FIGS. 9 and 10, the frontward middle wall 94 of the fixed waste ink tank case 81 forms the right edge of the left part 87. The frontward middle wall 94 has a rectangular plate-like shape expanding in the up and down direction 7 and the front and rear direction 8. The upper edge of the frontward milled wall 94 is disposed on a lower side with respect to the upper edge of the left half part of the front wall 91 and the upper edge of the rear wall 93. As a result, the inner space of the left part 87 and the inner space of the right part 88 communicate with each other in an upper portion of the right edge of the left part 87.

The lower wall 85A forming the lower edge of the left part 87 is a part of the lower wall 85, and has a rectangular plate-like shape expending in the front and rear direction 8 and the left and right direction 9.

As shown in FIGS. 9 and 10, the inner space of the right part 88 is partitioned by a rearward middle wall 95, the right half of the front wall 91, the rear wall 97 and the lower wall 85B.

The rearward middle wall 95 of the fixed waste ink tank case 81 forms the left edge of the right part 88. The rearward middle wall 95 has a rectangular plate-like shape expanding in the up and down direction 7 and the front and rear direction 8.

The rear wall 97 of the fixed waste ink tank case 81 forms the rear edge of the right part 88. The rear wall 97 has a rectangular plate-like shape expanding in the up and down direction 7 and the left and right direction 9.

As shown in FIGS. 7 and 8, the right half part of the front wall 91 of the fixed waste ink tank case 81 forms the front edge of the right part 88. A central portion of the front wall 91 in the left and right direction 9 and the front edge of the rearward middle wall 95 are spaced in the front and rear direction 8. With this configuration, the inner space of the right part 88 and the inner space of the left part 87 communicate with each other.

As shown in FIG. 8, the right wall 98 of the fixed waste ink tank case 81 forms the right edge of the right part 88. The right wall 98 has a rectangular plate-like shape expanding in the up and down direction 7 and the front and rear direction 8.

As shown in FIGS. 9 and 10, the lower wall 85B forming the lower edge of the right part 88 is a part of the lower wall 85, and has a rectangular plate-like shape expanding in the front and rear direction 8 and the left and right direction 9. In the up and down direction 7, the lower wall 85B is disposed at the same position as that of the upper edge of the frontward middle wall 94.

On the rear side with respect to the lower wall 85B, an opening 100 partitioned by the lower edge of the lower wall 85B, the front surface of the rear wall 97, the right surface of the rearward middle wall 95*m* and the left surface of the right wall 98 is formed.

As shown in FIGS. 7 to 10, in the inner space of the fixed waste ink tank case 81, the ink holding body 83 is provided. The ink holding body 83 is made of, for example, fiber materials such as a felt molded article. The waste ink flowed into the inner space of the fixed waste ink tank case 81 is absorbed and held by the ink holding body 83 made of fiber materials.

The ink holding body 83 is formed of a plurality of parts (five parts in this illustrative embodiment) each of which has a rectangular parallelepiped shape, and is disposed to be filled in the inner space of the fixed waste ink tank case 81.

As shown in FIG. 10, the ink holding body 83 has a projecting part 107 projecting downward from the lower surface of the ink holding body 83 at a rear edge part of a portion of the ink holding body 83 positioned in the inner space of the right part 88. The projecting part 107 has a flat rectangular parallelepiped shape extending in the left and right direction 9. The projecting part 107 is formed to project to the outside of the fixed waste ink tank case 81 through the opening 100 of the fixed waste ink tank case 81. That is, a lower edge 107B of the projecting part 107 extends to a lower position with respect to the rear wall 85B of the fixed waste ink tank case 81, and is exposed to the outside of the fixed waste ink tank case 81.

As shown in FIGS. 7 and 9, the fixed waste ink tank case 81 is provided with ports 101 and 102 to which the tubes 76 and 77 are connected, respectively. The ports 101 and 102 are disposed to be spaced from each other in the up and down direction 7. The port 102 disposed on the lower side with respect to the port 103 has a shape of a circular tube projecting to the left side from the left wall 92. The inner space of the port 102 penetrates through the left wall 92. The inner space of the port 102 lets the outside and the inner space of the fixed waste ink tank case 81 communicate with each other. To the port 102, the tube 77 is connected.

When the waste ink flows into the inner space of the fixed waste ink tank 80 through the tube 77 and the port 102, the waste ink moves to the lower portion in the left part 87 while being held and absorbed by the ink holding body 83, and then the lower portion in the left part 87 with respect to the port 102 is filled with the waste ink. Thereafter, the waste ink reaches the upper portion in the left part 87 with respect to the port 102 while passing through the ink holding body 83. Then, the waste ink moves to the rear portion in the inner space of the right part 88 while passing through the ink holding body 83, reaches the projecting part 107 of the ink holding body 83, and then moves downward.

As shown in FIG. 7, on the left surface of the left wall 92, a recessed part 105 is formed to be recessed downward. Specifically, as shown in FIG. 9, the left wall 92 branches, at a central portion 92A in the up and down direction 7, to an outer wall 92B extending straight and upward from the central portion 92A and an inner wall 92C extending upward after being bent rightward. The recessed part 105 is partitioned by the outer wall 92B, the inner wall 92C, the front wall 91 and the rear wall 93.

The upper port 101 is formed in a circular tube projecting rightward from the outer wall 92B of the left wall 92, and the inner space of the port 101 penetrates through the outer wall 92B. The inner space of the port 101 lets the inner space of the recessed part 105 and the outside communicate with each other. To the port 101, the tube 76 is connected.

(Movable Waste Ink Tank 110)

As shown in FIGS. 4 and 5, in a state where the movable waste ink tank 110 is disposed at the mounting position, the movable waste ink tank 110 is disposed on the rear side with respect to the central part of the inner space 35 of the lower cover 30 in the front and rear direction 8. The movable waste ink tank 110 is disposed on the rear side with respect to the ink refilling case 61, the ink cartridge 62 and the fixed waste ink tank 80. Furthermore, the movable waste ink tank 110 is disposed on the right side with respect to the right edge of the moving range of the carriage 67 in the left and right direction 9, i.e., the movable waste ink tank 110 is disposed, on the right side with respect to the right edge of the guide rails 43 and 44, at a position overlapping with the ink refilling case 61 and the ink cartridge 62 in the left and right direction 9. In other words, the movable waste ink tank 110 is disposed in a region overlapping, in the left and right direction 9, with a region in which the ink refilling case 61 and the ink cartridge 62 are provided and in a region overlapping, in the front and rear direction 8, with a region in which the carriage 67 is provided. Furthermore, the movable waste ink tank 110 is disposed at a position overlapping with the supply tray 20 in the up and down direction 7.

As shown in FIGS. 7 and 8, the movable waste ink tank 110 includes a movable waste ink tank case 111 and an ink holding body 113.

The movable ink tank case 111 has a hollow box shape, and has an opening 117 on the upper side. The outer shape of the movable ink tank case 111 is a rectangular parallelepiped shape which is thin in the left and right direction 9 and is extended in the front and rear direction 8. The opening 117 is partitioned by the upper edge of the movable waste ink tank case 111. The movable waste ink tank case 111 includes an front wall 141, a rear wall 142, a left wall 143, a right wall 144 and a lower wall 116 (see FIG. 11), and the inner space partitioned by these walls is filled with the ink holding body 113. The upper edge of the rear wall 142, the upper edge of the left wall 143 being at the same position as the upper edge of the rear wall 142 in the up and down direction 7, and the upper edge of the right wall 144 constitute the upper edge 115 of the movable waste ink tank 110. The upper edge 115 is disposed on the upper side with respect to the upper edge of the supply tray 20.

Figure 11:
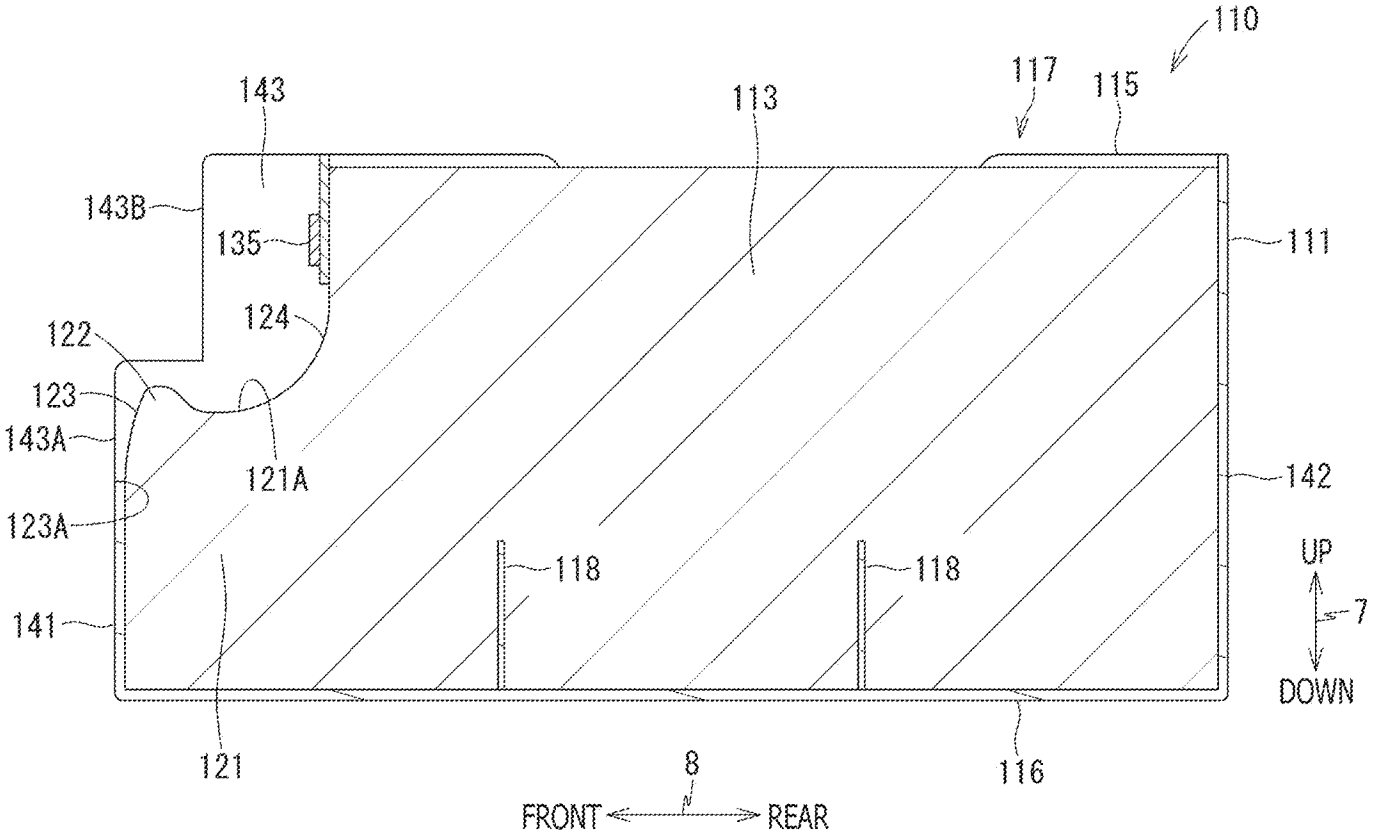
FIG. 11 is a cross sectional view of the movable waste ink tank in the B-B cross section in FIG. 8.

As shown in FIG. 11, the lower portion of the front edge of the movable waste ink tank case 111 is projected frontward with respect to the upper portion of the front edge. In the state where the movable ink tank 110 is disposed at the mounting position, the lower portion of the front edge of the movable waste ink tank case 111 is disposed on the lower side with respect to the lower wall 85B of the right part 88 of the fixed waste ink tank case 81.

The right wall 144 has a rectangular plate-like shape expanding in the up and down direction 7 and the front and rear direction 8. Although not shown in the drawings, the lower portion of the front edge of the right wall 144 is projected frontward with respect to an upper portion 144B (see FIG. 8) of the front edge of the right wall 144.

As shown in FIG. 11, the left wall 143 has a rectangular plate-like shape expanding in the up and down direction 7 and the front and rear direction 8. A lower portion 143A of the front edge of the left wall 143 is projected frontward with respect to an upper portion 143B of the front edge of the left wall 143.

As shown in FIG. 7, the left wall 143 has a recessed part 145 formed such that the upper edge of the left wall 143 is recessed downward in the central portion in the front and rear direction 8. By the recessed par 145, an opening 119 penetrating through the left wall 143 in the left and right direction 9 is formed. With this configuration, when the ink adhered to the wiper 45 is scattered by letting the wiper 45 wipe the nozzles 69 of the recording head 65, scattered ink drops are adhered to the ink holding body 113. Then, the ink drops are held by the ink holding body 113.

The left wall 143 and the right wall 144 have the same shape excepting the recessed part 145, and are disposed at the same position in the up and down direction 7 and the front and rear direction 8.

As shown in FIG. 11, the front wall 141 has a rectangular plate-like shape expanding in the up and down direction 7 and the left and right direction 9. The front wall 141 is provided to extend between the lower portion 143A of the front edge of the left wall 143 and the lower portion (not shown) of the front edge of the right wall 144. The upper edge of the front wall 141 is disposed on the lower side with respect to the upper edge of the lower portion 143A of the front edge of the left wall 143.

The rear wall 142 has a rectangular plate-like shape expanding in the up and down direction 7 and the left and right direction 9. The rear wall 142 is provided to extend between a rear edge of the left wall 143 and a rear edge (see FIG. 8) of the right wall 144.

The inner space of the movable waste ink tank case 111 is partitioned by the front wall 141, the rear wall 142, the left wall 143, the right wall 144 and the lower wall 116.

As shown in FIG. 11, the movable waste ink tank case 111 is formed with two ribs 118 which project upward from the upper surface of the lower wall 116 and extend in the left and right direction 8. The length of each rib 118 in the up and down direction 7 is approximately ⅓ of the length of the movable waste ink tank case 111 in the up and down direction 7. Left edge and right edge of each rib 118 are connected the right surface of the left wall 143 and the left surface of the right wall 144, respectively. The front wall 141, the ribs 118 and the rear wall 142 are disposed to be spaced with respect to each other in the front and rear direction 8.

As shown on FIGS. 7, 8 and 11, in the inner space of the movable ink tank case 111, the ink holding body 113 is provided. The ink holding body 113 is made of, for example, fiber materials such as a felt molded article. The waste ink flowed into the inner space of the movable waste ink tank case 111 is absorbed and held by the ink holding body 113 made of fiber materials.

The ink holding body 113 has a rectangular parallelepiped shape, and is formed of a plurality of parts (two parts in this illustrative embodiment) as shown in FIG. 8. As shown in FIG. 11, the ink holding body 113 has a projecting part 121 which projects frontward in a region extending from the central portion to the lower portion at the front edge of the ink holding body 113. The projecting part 121 has, at the front edge portion of an upper surface 121A of the projecting part 121, a hill part 122 which is formed to project upward from the upper surface 121A of the projecting part 121. In the upper portion of the front surface of the projecting part 121, a forward tilting surface 123 is formed to be tilted with respect to the up and down direction 7 such that the tilting surface becomes higher toward the rear side. The upper edge portion of the forward tilting surface 123 forms the front surface of the hill part 122. The degree of tilting of the forward tilting surface 123 becomes milder toward the rear side.

On the rear side with respect to the hill part 122 on the upper surface 121A of the projecting part 121, a contact surface 124 is formed to be tilted with respect to the up and down direction 7 and to extend upward toward the rear side. The degree of tilting of the contact surface 124 becomes steeper toward the rear side.

(Guide Parts 131 and 132)

Figure 13:
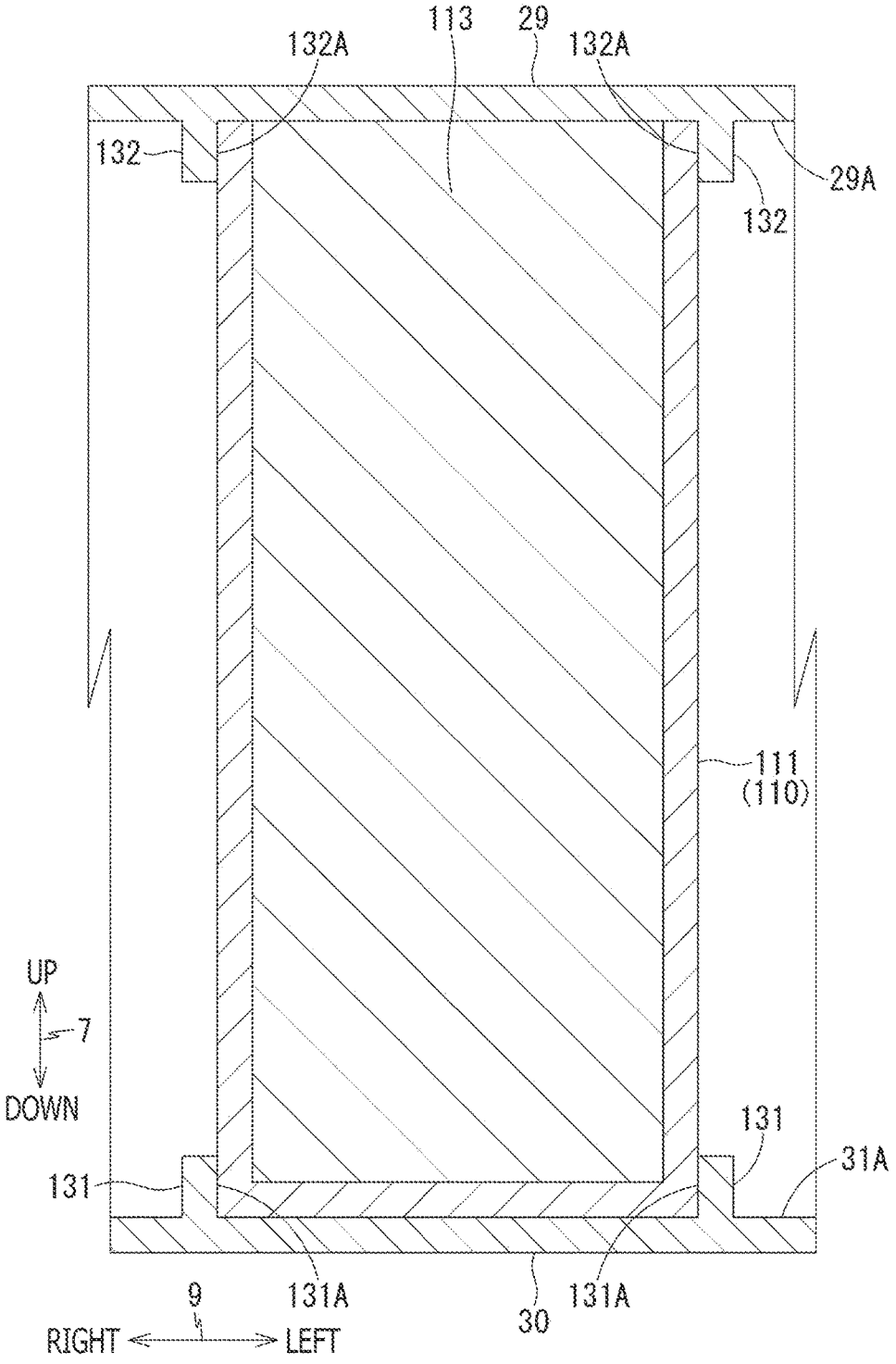
FIG. 13 is a partial cross sectional view of the movable waste ink tank and guide parts in a D-D cross section in FIG. 5.

As shown in FIG. 13, the lower cover 30 has a pair of guide parts 131, and the upper cover 29 has a pair of guide parts 132. The guide parts 131 are disposed on the rear side with respect to the central portion in the space 35 (see FIGS. 4 to 6) of the lower cover 30 in the front and rear direction 8 and on the lower side with respect to the movable waste ink tank 110 at the mounting position. Each of the guide parts 131 is formed to project upward from the upper surface 31A of the lower wall 31 of the lower cover 30 and to extend in the front and rear direction 8. The pair of guide parts 131 are disposed to be parallel with each other and to be spaced in the left and right direction 9. The interval between inner surfaces 131A of the pair of guide parts 131 facing with each other corresponds to the length of the movable waste ink tank 110 in the left and right direction 9. The guide part 131 has a rectangular cross section in the left and right direction 9.

The pair of guide parts 132 are formed to project downward from the lower surface 29A of the upper cover 29 on the upper side of the pair of guide parts 131. The pair of guide parts 132 has the same shape as that of the pair of guide parts 131, and are disposed at the same position as that of the pair of guide parts 131 in the front and rear direction 8 and the left and right direction 9. The interval between inner surfaces 132A of the pair of guide parts 132 facing with each other corresponds to the length of the movable waste tank 110 in the left and right direction 9.

In the state where the movable waste ink tank 110 is disposed at the mounting position, the lower edge portion of the left surface of the left wall 143 and the lower edge portion of the right surface of the right wall 144 respectively contact the inner surfaces 131A of the guide parts 131. In addition, the upper edge portion of the left surface of the left wall 143 and the upper edge portion of the right surface of the right wall 144 respectively contact the inner surfaces 132A of the guide parts 132. The movable waste ink tank 110 is movable in the front and rear direction 8 with respect to the front end position defined when the movable waste ink tank 110 is disposed at the mounting position by letting the lower edge portions of the left surface of the left wall 143 and the right surface of the right wall 144 slide with respect to the inner surfaces 131A of the guide parts 131 and letting the upper edge portions of the left surface of the left wall 143 and the right surface of the right wall 144 slide with respect to the inner surfaces 132A of the guide parts 132.

As shown in FIG. 10, in the fixed waste ink tank 80, the rearward middle wall 95 is disposed slightly on the right side with respect to the frontward middle wall 94.

As shown in FIG. 8, the fixed waste ink tank 80 is configured such that an upper part 98A of the right wall 98 formed on the upper side with respect to the central portion of the right wall 98 in the up and down direction 7 is disposed on the left side with respect to a lower part 98B of the right wall 98 formed on the lower side with respect to the central part of the right wall 98 in the up and down direction 7. With this configuration, in the central part of the right wall 98 in the up and down direction 7, a horizontal part 98C expanding in the front and rear direction 8 and the left and right direction 9 is formed. The lower edge part of the right wall 98 has an extended part 98D formed to extend rearward.

As shown in FIG. 8, the length between the right surface of the left wall 143 and the left surface of the right wall 144 corresponds to the length between the left surface of the rearward middle wall 95 of the fixed waste tank case 81 and the right surface of the upper part 98A of the right wall 98. The length between the left surface of the left wall 143 and the right surface of the right wall 144 corresponds to the length between the right surface of the frontward middle wall 94 and the left surface of the lower part 98B of the right wall 98 of the fixed waste ink tank case 81.

As shown in FIGS. 7 and 8, in the state where the movable waste ink tank 110 is disposed at the mounting position, the front edge part of the right part 88 of the fixed waste ink tank 80 is disposed between the left wall 143 and the right wall 144 of the movable waste ink tank 80. Furthermore, in this state, the lower edge part of the front edge part of the movable waste ink tank 110 is disposed between the lower part 98B of the right wall 98 and the frontward middle wall 94 of the fixed waste ink tank 80. In this state, the front edge of the left wall 143 of the movable waste ink tank 110 contacts the rear surface of the rear wall 93 of the left part 87 of the fixed waste ink tank 80, and the front edge of the right wall 144 of the movable ink tank 110 contacts the rear edge of the horizontal part 98C of the right wall 98 of the fixed waste ink tank 80. As a result, the movable waste ink tank 110 is restricted from moving frontward with respect to the mounting position.

In the state where the movable waste ink tank 110 is disposed at the mounting position, an engagement part (not shown) of the movable waste ink tank 110 and an engagement part (not shown) of the lower cover 30 engage with each other. As a result, in the state where the movable waste ink tank 110 is disposed at the mounting position, the movable waste ink tank 110 is prevented from being unintentionally moved rearward. An engagement part may be provided such that the movable waste ink tank 110 and the fixed waste ink tank 80 engage with each other. Furthermore, the movable waste ink tank 110 may be attached to the printer housing 11 by a screw.

Figure 14:
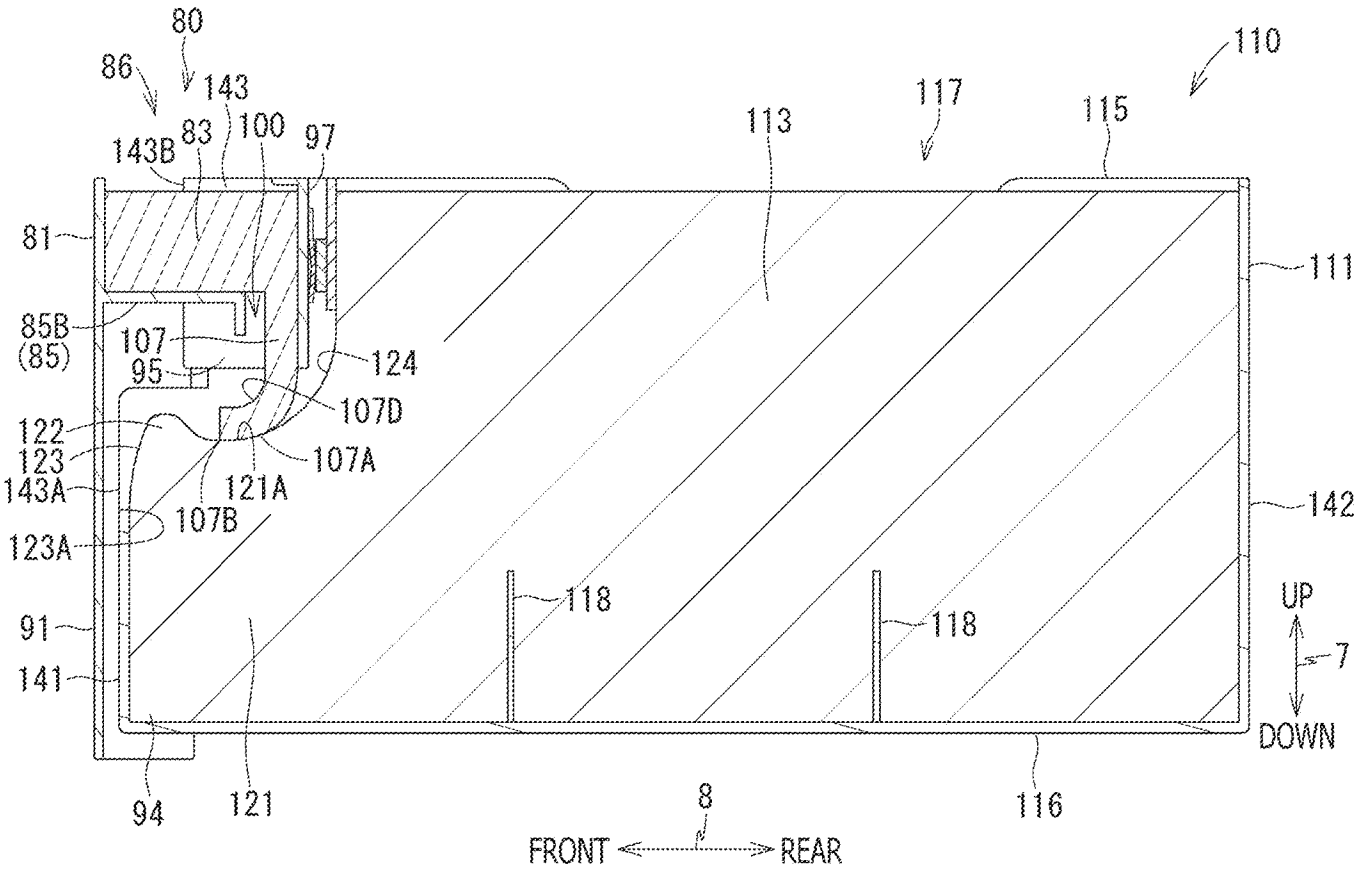
FIG. 14 is a cross sectional view in the line B-B cross section in FIG. 8 illustrating a state where the movable waste ink tank is disposed at the mounting position.
Figure 15:
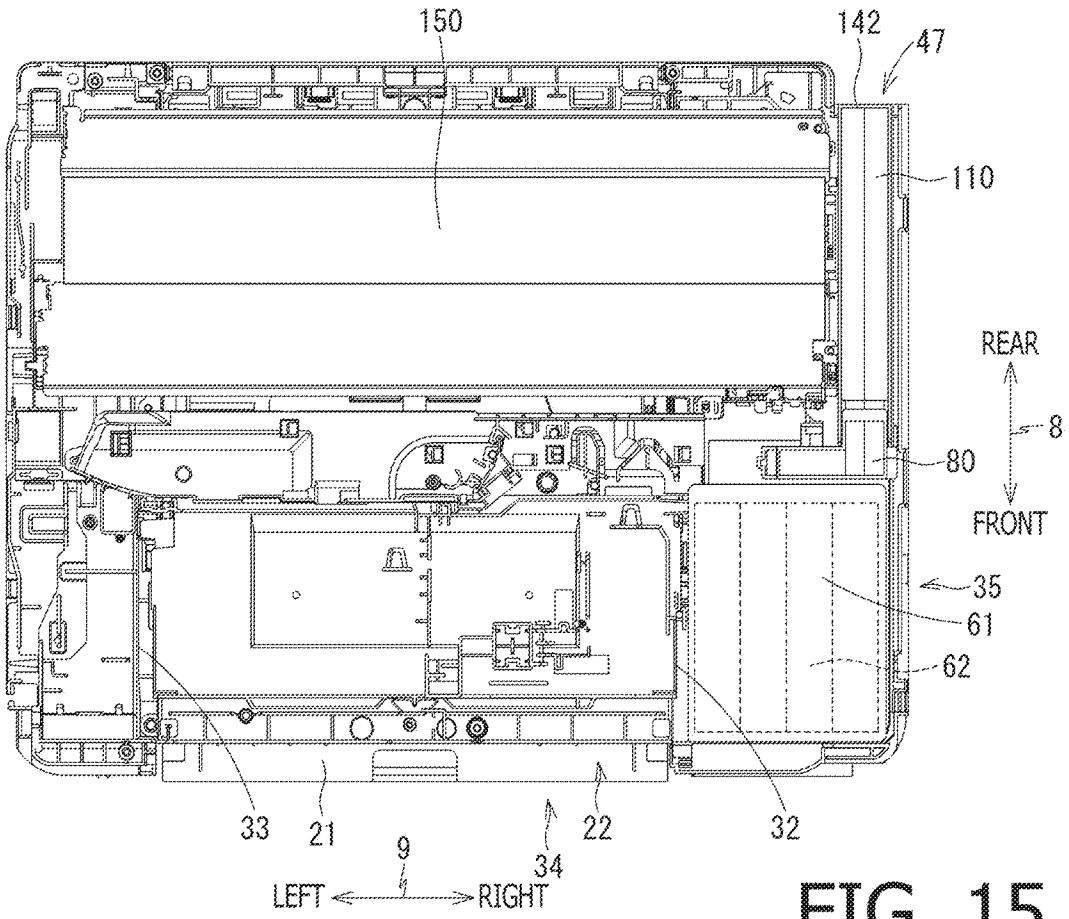
FIG. 15 is a plan view illustrating an inner configuration of a printer unit according to a variation of the illustrative embodiment.

As shown in FIG. 14, in the state where the movable waste ink tank 110 is disposed at the mounting position, the waste ink flows into the inner space of the fixed waste ink tank 80 through the port 102. First, in the inner space of the fixed waste ink tank 80, the waste ink moves downward from the port 102 of the left part 87 while being held and absorbed by the ink holding body 83, and then the lower portion of the left part 87 is filled with the waste ink. Then, the waste ink reaches the upper portion in the left part 87 with respect to the port 102 while passing through the ink holding body 83. Then, the waste ink moves to the rear portion in the inner space of the right part 88 while passing through the ink holding body 83, reaches the projecting part 107 of the ink holding body 83, and moves downward to the lower edge of the projecting part 107. Then, the waste ink moves to the ink holding body 113 of the movable waste ink tank 110 via the contacting surface 124 and is held and absorbed by the ink holding body 113. Thereafter, the waste ink is further moves, in the movable waste ink tank 110, from the front portion to the rear portion of the ink holding body 113. As a result, the waste ink is absorbed and held by the ink holding body 113 of the movable waste ink tank 110.

In the state where the movable waste ink tank 110 is disposed at a non-mounting position shown in FIG. 6, the projecting part 107 of the ink holding body 83 of the fixed waste ink tank 80 extends downward as shown in FIG. 10. In this state, the upper surface 121A of the projecting part 121 of the ink holding body 113 in the movable waste ink tank 110 is disposed at an upper position with respect to the lower edge 107B of the rear surface 107A of the projecting part 107 of the ink holding body 83 in the fixed waste ink tank 80.

Therefore, in the state where the movable waste ink tank 110 is disposed at the mounting position, the projecting part 107 elastically deforms and the lower part from the central part of the projecting part 107 in the up and down direction 7 is bent frontward. Further, the rear surface 107A of the projecting part 107 contacts the contacting surface 124 to be along the inclination of the contacting surface 124. That is, the projecting part 107 of the ink holding body 83 contacts the contacting surface 124 of the ink holding body 113 in regard to the up and down direction 7. In this case, the projecting part 107 is disposed at an upper position with respect to the contact surface 124.

(Attachment/Detachment of Movable Waste Ink Tank 110)

As shown in FIGS. 5 and 6, the printer housing 11 has, at the right edge part of the rear portion, the opening 47 penetrating through in the front and rear direction 8. In the state where the movable waste ink tank 110 is disposed at the mounting position, the opening 47 is closed by the rear wall 142 of the movable waste ink tank 110.

The movable waste ink tank 110 is replaceable. When the movable waste ink tank 110 is detached, a user withdraws rearward, through the opening 47 of the printer housing 11, the movable waste ink tank 110 disposed at the mounting position. When the movable waste ink tank 110 is attached, the user pushes the movable waste ink tank 110 toward the mounting position through the opening 47 of the printer housing 11.

(Advantageous Effects)

As described above, the movable waste ink tank 110 is disposed at the position not affecting increase in size of the multifunction apparatus 10 in the left and right direction 9 caused by the ink filling case 61 and the cartridge 62. Therefore, the movable waste ink tank 110 can be disposed without interfering with the other components, i.e., the movable waste ink tank 110 can be disposed effectively in regard to space saving. As a result, the multifunction apparatus 10 is prevented from increasing in size. Furthermore, the moving range of the carriage 67 in the left and right direction 9 is set in conformity with the width of the maximum recordable size of the recording medium. For example, when the ink refilling case 61 and the ink cartridge 62 are increased in the left and right direction 9 but the width of the maximum recordable size of the recording medium does not change, the movable waste ink tank 110 can be increased in size in the left and right direction 9 in accordance with increase of the ink refilling case 61 and the ink cartridge 62.

There is a concern that, when the ink refilling case 61 and the ink cartridge 62 are disposed at an upper position with respect to the supply tray 20, ink may leak into the supply tray 20 and adhere to an electronic circuit board provided in the multifunction apparatus 10. However, in this respect, since, according to the illustrative embodiment, the ink refilling case 61 and the ink cartridge 62 are disposed in the space 35 at the right side with respect to the supply tray 20, occurrence of the above described phenomenon can be prevented.

The height of the movable waste ink tank 110 reaches the position upper than the upper edge of the supply tray 20, a larger amount of waste ink can be stored in the movable waste ink tank 110.

Since the movable waste ink tank 110 can be detachably attachable to the printer housing 11, the movable waste ink tank 110 is replaceable. When the movable waste ink tank 110 is attached to or detached from the printer housing 11, the movable waste ink tank 110 is disposed at the position not interfering with the other components. In other words, the movable waste ink tank 110 is effectively disposed at an easily attachable position while attaining space saving.

Since the printer housing 11 includes the guide parts 131 and 132 which guide the movable waste ink tank 110 to be movable in the front and rear direction 8, the movable waste ink tank 110 can be moved while avoiding obstacles.

Since the fixed waste ink tank 80 is provided n addition to the movable waste ink tank 110, a larger amount of waste ink can be stored.

The movable waste ink tank 110 includes the ink holding body 113, and the fixed waste ink tank 80 includes the ink holding body 83. Regarding the ink holding body 113 and the ink holding body 83, the ink holding body 83 is disposed at an upper position with respect to the ink holding body 113, and the ink holding body 83 contacts the ink holding body 113 in the state where the ink holding body 113 is disposed at a lower position with respect to the ink holding body 83. Therefore, the ink held in the ink holding body 83 in the fixed waste ink tank 80 can easily move from the ink holding body 83 to the ink holding body 113 through the rear surface 107A of the projecting part 107 and the contact surface 124 of the ink holding body 113. The ink can be more securely moved from the fixed waste ink tank 80 to the movable waste ink tank 110. As a result, the ink can be prevented from leaking to the outside of the movable waste ink tank 110.

Since the tubes 76 and 77 are connected to the fixed waste ink tank 80 fixed to the printer housing 11, the configuration of the movable waste ink tank 110 can be simplified.

The movable waste ink tank 110 is disposed on the upstream side with respect to the wiper 45 in regard to the moving direction in which the recording head 65 contacting the wiper 45 moves. The movable waste ink tank case 111 has the opening 119 disposed at a side on which the wiper 45 is disposed. Therefore, when the ink is scattered from the wiper 45, the ink holding body 113 of the movable waste ink tank 110 receives the scattered ink.

(Variations)

In the above described illustrative embodiment, the recording head 65 is mounted on the carriage 67 and the carriage 67 is configured to be movable in the left and right direction 9. In place of such a configuration, a recording head 150 having the length longer than the width of the recording medium 19 in the left and right direction 9 may be used. In such a configuration, the ink refilling case 61 and the ink cartridge 62 are disposed at the position not interfering with the recording head 150 in the front and rear direction 8, and is disposed at the rightward position with respect to the recording head 150. The movable waste ink tank 110 is disposed at the position interfering with the ink refilling case 61 and the ink cartridge 62 in the left and right direction 9, and is disposed at the rightward position with respect to the recording head 150.

In the above described illustrative embodiment, the ink cartridge 62 is used as an example of an ink storing part, and the ink refilling case 61 to which the ink cartridge 62 is detachably attachable is provided in the multifunction apparatus 1. However, in replace of the ink refilling case 61, an ink tank of which inner space is formed as a hollow part which can be refilled with ink may be provided at the disposed position of the ink refilling case 61 on the lower cover 30.

In the above described illustrative embodiment, the ink refilling case 61 and the ink cartridge 62 are disposed only at the rightward space 35 in the lower cover 30; however, the ink refilling case 61 and the ink cartridge 62 may be disposed separately at the space on the leftward position with respect to the left wall 33 and the space 35 in the lower cover 30. In such a configuration, the movable waste ink tank 110 may also be disposed at a right position with respect to the right edge of the guide rails 43 and 44 and a left position with respect to the left edge of the guide rails 43 and 44.

The multifunction apparatus 10 may be configured not to use the fixed waste ink tank 80. In such a case, in the state where the movable waste ink tank 110 is disposed at the mounting position, the tubes 76 and 77 are directly connected to the movable waste ink tank 110.

The direction in which the movable waste ink tank 110 is detachably attachable is not limited to the front and rear direction 8. The direction in which the movable waste ink tank 110 is detachably attachable may be a direction intersecting with the left and right direction 9. Further, the movable waste ink tank 110 may not be detachably attachable to the printer housing 11. In place of the movable waste ink tank 110, a waste ink tank fixed to the printer housing 11 may be used.

In the above described illustrative embodiment, the fixed waste ink tank 80 is disposed between the carriage 67 and the ink refilling case 61 and the ink cartridge 62 in the front and rear direction 8, and is disposed at the position interfering with the moving range of the carriage 67 in the left and right direction 9. However, the fixed waste ink tank 80 may be disposed at another position. For example, the fixed waste ink tank 80 may be disposed at a position which is outside with respect to the moving range of the carriage 67 in the left and right direction 9 and which interfering with the movable waste ink tank 110 in the up and down direction 7.

In the above described illustrative embodiment, the waste ink is moved from the fixed waste ink tank 80 to the movable waste ink tank 110 by letting the ink holding body 83 of the fixed waste ink tank 80 and the ink holding body 113 of the movable waste ink tank 110 contact with each other. However, ink holding bodies may not be necessarily provided in both of the fixed waste ink tank 80 and the movable waste ink tank 110. For example, one or both of the fixed waste ink tank 80 and the movable waste ink tank 110 may be configured not to have an ink holding body. In this case, the fixed waste ink tank 80 and/or the movable waste ink tank 110 may be configured to store ink in an inner space thereof.

What is claimed is:

1. An inkjet printing apparatus, comprising:

a carriage configured to move in a 1st direction;

a recording head arranged on the carriage, the recording head having nozzles through which ink is ejected;

an ink reservoir configured to be connected to the recording head to supply ink to the recording head;

an ink receiver configured to receive the ink discharged from the recording head;

a housing;

a waste liquid reservoir configured to be connected to the ink receiver to let the ink move between the ink receiver and the waste liquid reservoir, wherein the waste liquid reservoir is configured to be detachably attachable to the housing; and an additional waste liquid reservoir configured to be connected to the ink receiver and the waste liquid reservoir to let the ink move between the ink receiver, the waste liquid reservoir and the additional waste liquid reservoir, wherein:

the ink reservoir is disposed not to overlap with the carriage in a 2nd direction perpendicularly intersecting with the 1st direction and an up and down direction, and at least a part of the ink reservoir is disposed at a position outside of a moving range of the carriage in the 1st direction; and in the 1st direction, the waste liquid reservoir is disposed to overlap with the ink reservoir and is disposed at a position outside of the moving range of the carriage.

2. The inkjet printing apparatus according to claim 1, further comprising a supply tray disposed at a lower position with respect to the recording head, the supply tray being configured to support sheets, wherein the waste liquid reservoir is disposed to overlap with the supply tray in the up and down direction, and an upper edge of the waste liquid reservoir is disposed at an upper position with respect to an upper edge of the supply tray.

3. The inkjet printing apparatus according to claim 1, wherein the housing comprises a guide part configured to guide the waste liquid reservoir in a direction intersecting with the 1st direction.

4. The inkjet printing apparatus according to claim 1, wherein the additional waste liquid reservoir is disposed to overlap with the moving range of the carriage in the 1st direction and is disposed at a position between the ink reservoir and the carriage in the 2nd direction.

5. The inkjet printing apparatus according to claim 4, wherein:

the waste liquid reservoir comprises a 1st holding body configured to hold ink;

the additional ink reservoir comprises a 2nd holding body configured to hold ink; and the 1st holding body and the 2nd holding body are disposed to contact with each other.

6. The inkjet printing apparatus according to claim 5, wherein the 1st holding body and the 2nd holding body contact with each other in the up and down direction in a state where the 1st holding body is disposed at a lower position with respect to the 2nd holding body.

7. The inkjet printing apparatus according to claim 4, wherein the additional waste liquid reservoir is fixed to the housing.

8. The inkjet printing apparatus according to claim 1, further comprising a wiper configured to contact the recording head, wherein the waste liquid reservoir is disposed on an upstream position with respect to the wiper in regard to a direction in which the recording head contacting the wiper moves.

9. The inkjet printing apparatus according to claim 8, wherein the waste liquid reservoir comprises:

a holding body configured to hold ink; and a reservoir housing in which the holding body is housed, wherein the reservoir housing comprises an opening disposed on a side on which the wiper is disposed.

10. An inkjet printing apparatus, comprising:

a recording head configured to extend in a 1st direction perpendicularly intersecting with a conveying direction in which a sheet is conveyed, the recording head having nozzles through which ink is ejected to the sheet;

an ink reservoir configured to be connected to the recording head to supply ink to the recording head;

an ink receiver configured to receive the ink discharged from the recording head;

a waste liquid reservoir configured to be connected to the ink receiver to let the ink move between the ink receiver and the waste liquid reservoir;

an additional waste liquid reservoir configured to be connected to the ink receiver and the waste liquid reservoir to let the ink move between the ink receiver, the waste liquid reservoir and the additional waste liquid reservoir, wherein:

the ink reservoir is disposed not to overlap with the recording head in a 2nd direction perpendicularly intersecting with the 1st direction and an up and down direction, and at least a part of the ink reservoir is disposed at a position outside of the recording head in the 1st direction; and in the 1st direction, the waste liquid reservoir is disposed to overlap with the ink reservoir and is disposed at a position outside of the recording head.

* * * * *